US010775094B2

(12) United States Patent
Cha et al.

(10) Patent No.: US 10,775,094 B2
(45) Date of Patent: Sep. 15, 2020

(54) REFRIGERATOR

(71) Applicant: LG ELECTRONICS INC., Seoul (KR)

(72) Inventors: Kyunghun Cha, Seoul (KR); Soyoon Kim, Seoul (KR); Myungjin Chung, Seoul (KR); Kyungseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 270 days.

(21) Appl. No.: 15/947,069

(22) Filed: Apr. 6, 2018

(65) Prior Publication Data

US 2018/0306484 A1 Oct. 25, 2018

(30) Foreign Application Priority Data

Apr. 24, 2017 (KR) ..... 10-2017-0052461

(51) Int. Cl.
*F25D 17/08* (2006.01)
*F25D 23/00* (2006.01)
(Continued)

(52) U.S. Cl.
CPC ..... *F25D 17/08* (2013.01); *F25B 39/02* (2013.01); *F25D 17/062* (2013.01);
(Continued)

(58) Field of Classification Search
CPC ..... F25D 2317/06; F25D 2317/067; F25D 17/062; F25D 11/022; F25D 17/08
See application file for complete search history.

(56) References Cited

U.S. PATENT DOCUMENTS 5,460,010 A * 10/1995 Kobayashi ..... F25D 17/045 62/187
5,546,759 A † 8/1996 Lee
(Continued)

FOREIGN PATENT DOCUMENTS

CN 1928467 3/2007
DE 10 2011 002 64 * 1/2011 ..... F25D 11/022
(Continued)

OTHER PUBLICATIONS

European Office Action dated Oct. 2, 2019 issued in Application No. 18168912.6.
(Continued)

*Primary Examiner* — Cassey D Bauer
(74) *Attorney, Agent, or Firm* — Ked & Associates, LLP

(57) ABSTRACT

A refrigerator according to an embodiment includes: a duct dividing the inside of a storage compartment body into a storage compartment and an air channel and having a main discharge port and a sub-discharge port; an air guide dividing the air channel into a first channel communicating with the main discharge port and a second channel guiding air in the first channel to the sub-discharge port; a heat exchanger provided in the first channel; and a fan suctioning air in the storage compartment and sending the air to the first channel. According to the refrigerator, it is possible to maximize the volume of the storage compartment and separately discharge air to the main discharge port and the sub-discharge port, using a simple structure.

17 Claims, 7 Drawing Sheets

(51) Int. Cl.

| | |
|---|---|
| ***F25B 39/02*** | (2006.01) |
| ***F25D 17/06*** | (2006.01) |
| *F25D 17/04* | (2006.01) |

(52) U.S. Cl.

CPC ..... *F25D 17/065* (2013.01); *F25D 23/006* (2013.01); *F25D 17/042* (2013.01); *F25D 2317/061* (2013.01); *F25D 2317/063* (2013.01); *F25D 2317/067* (2013.01); *F25D 2317/0683* (2013.01); *F25D 2500/02* (2013.01)

(56) References Cited

U.S. PATENT DOCUMENTS

| | | | | |
|---|---|---|---|---|
| 9,086,234 | B2 † | 7/2015 | Gu | |
| 2010/0180620 | A1 * | 7/2010 | Lee | F25D 17/067 62/291 |
| 2013/0015753 | A1 * | 1/2013 | Son | F25D 17/042 312/405 |
| 2016/0282037 | A1 † | 9/2016 | Han | |

FOREIGN PATENT DOCUMENTS

| | | |
|---|---|---|
| EP | 1 586 837 | 10/2005 |
| EP | 2 146 164 | 1/2010 |
| KR | 20-2009-0008159 | 8/2009 |
| KR | 10-2016-0023105 | 3/2016 |
| WO | WO 2012/091256 | 7/2012 |
| WO | WO 2016/036005 | 3/2016 |

OTHER PUBLICATIONS

European Search Report dated Aug. 27, 2018 issued in EP Application No. 18168912.6.

* cited by examiner
† cited by third party

REFRIGERATOR

CROSS-REFERENCE TO RELATED APPLICATION

This application claims priority under 35 U.S.C. § 119 to Korean Application No. 10-2017-0052461, filed on Apr. 24, 2017, whose entire disclosure is hereby incorporated by reference.

BACKGROUND

1. Field

The present disclosure relates to a refrigerator and, more particularly, to a refrigerator having storage compartments that are cooled by a heat exchanger.

2. Background

A refrigerator is an apparatus that receives and cools objects, such as food, medicine, or cosmetics, to a relatively low temperature to help prevent decay and deterioration of the objects. The refrigerator may typically include a storage compartment that receives the objects, and a cooling device that cools the storage compartment.

The cooling device may include, for example, a thermoelectric module (TEM) or a refrigeration cycle having a compressor, a condenser, an expansion device, and an evaporator. The refrigerator may further include a fan that circulates air between the storage compartment and the cooling device. The fan may be provided around the evaporator or the thermoelectric module, and the fan may blow air in the storage compartment to the evaporator or the thermoelectric module to be cooled and then back to the storage compartment.

When a refrigerator includes a refrigeration cycle, a fin tube heat exchanger or a roll bond heat exchanger may be used as an evaporator. The roll bond heat exchanger may be smaller in front-rear thickness than the fin tube heat exchanger, and when they are used as evaporators, a refrigerator equipped with the roll bond heat exchanger may have a storage compartment with a relatively larger volume than a refrigerator equipped with the fin tube heat exchanger.

An example of a refrigerator equipped with a roll bond heat exchanger as an evaporator is discussed in Korean Patent Application Publication No. 10-2016-0023105 A (published on Mar. 3, 2016), and the refrigerator in this reference has a roll bond heat exchanger that is spaced from a rear plate provided in the refrigerator. Additionally, a plurality of channels may be formed behind the rear plate by the roll bond heat exchanger.

In another example, a refrigerator that may include a separate storage container, such as a pantry in a storage compartment, is discussed in Korean Utility Model No. 20-2009-0008159 U (published on Aug. 14, 2009). In this reference, the refrigerator keeps food in the pantry that is separate from a storage compartment.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Hereinafter, specific embodiments of the present disclosure are described in detail with reference to drawings.

Figure 1:
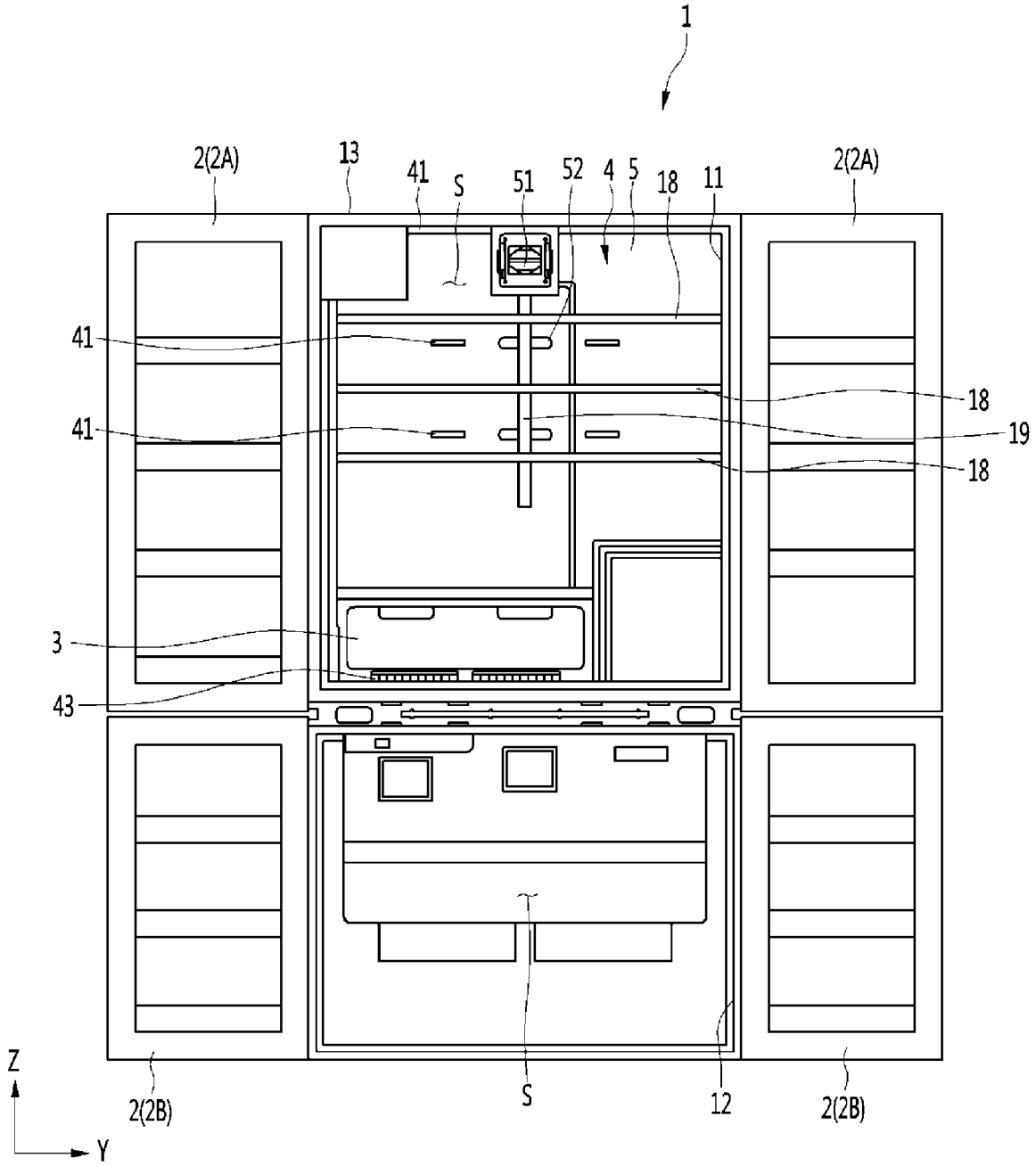
FIG. 1 is a front view of a refrigerator according to an embodiment of the present disclosure with storage compartments open.
Figure 2:
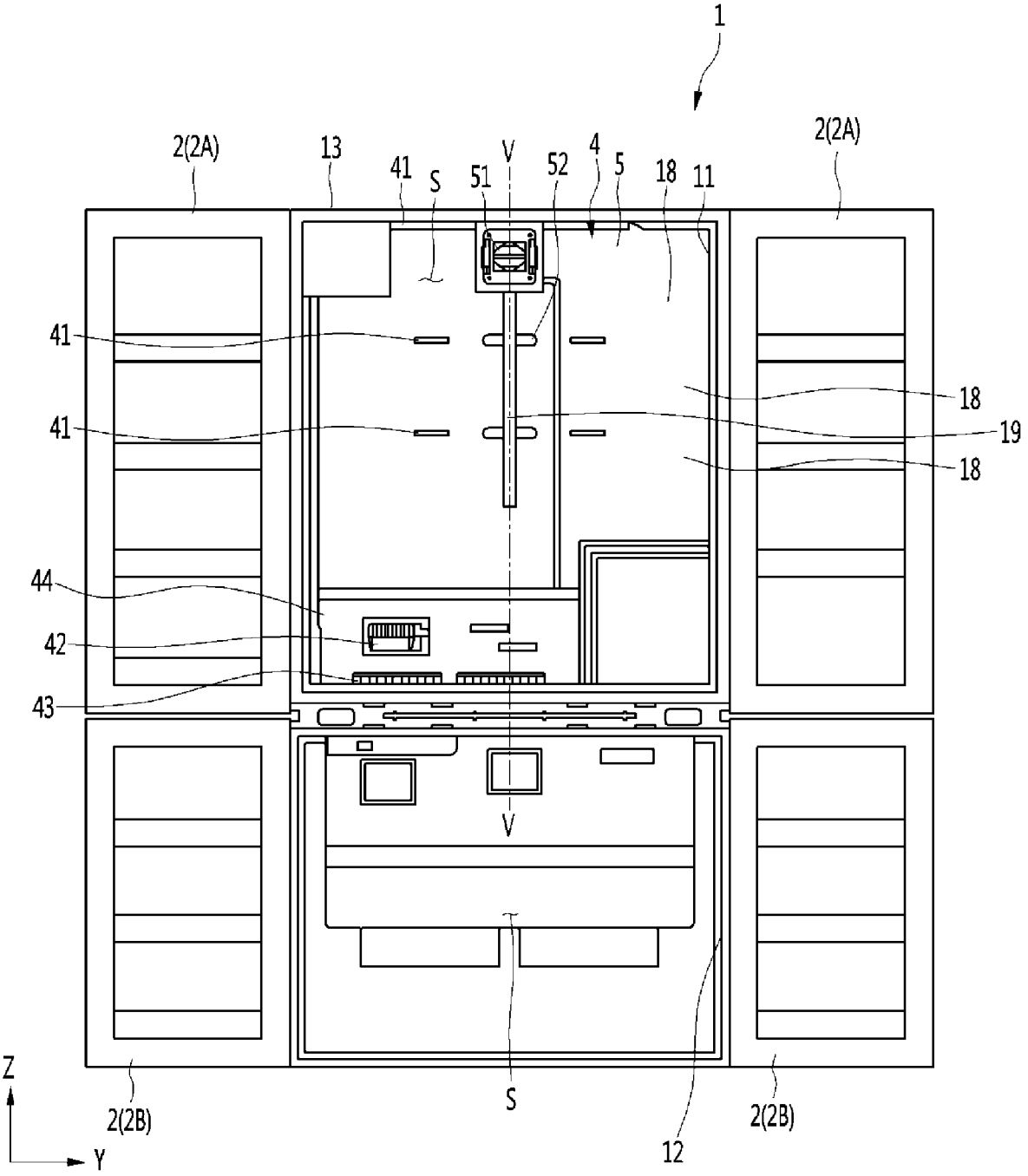
FIG. 2 is a front view of the refrigerator shown in FIG. 1 with shelves and a pantry separated.

FIG. 1 is a front view of a refrigerator according to an embodiment of the present disclosure with doors open to expose the storage compartments, and FIG. 2 is a front view of the refrigerator shown in FIG. 1 without shelves or a pantry. The refrigerator may include a main body 1 having storage compartments S and doors 2 opening/closing the storage compartments S.

The main body 1 may include storage compartment bodies 11 and 12 having the storage compartments S. The storage compartment bodies 11 and 12 may be opened on the front side and may have a top plate, a bottom plate, a left plate, a right plate, and a rear plate. The main body 1 may further include an outer case 13 forming the external appearance of the refrigerator. The main body 1 may further include an insulator 14 provided between the storage compartment bodies 11 and 12 and the outer case 13.

A plurality of storage compartment bodies 11 and 12 may be provided in the main body 1. The main body 1 may further include an insulator provided between the storage compartment bodies 11 and 12. A refrigerator may include at least two storage compartments S, and the storage compartments S may be cooled at different temperatures. In one example, one of the storage compartments S may be a refrigerator compartment having a temperature range above the freezing point for water, and another storage compartment S may be a freezer compartment having a temperature range below the freezing point for water. For instance, a refrigerator may have both of a refrigerator compartment and a freezer compartment, and the main body 1 may include a storage compartment body 11 having the refrigerator compartment and a storage compartment body 12 having the freezer compartment.

A least one door 2 may be provided to the refrigerator. When the main body 1 includes a plurality of storage compartment bodies 11 and 12, the doors 2 of the main body 1 may be composed of a plurality of doors 2A and 2B. One or more doors 2A may open/close the storage compartment formed in the storage compartment body 11, and one or more doors 2B may open/close the storage compartment formed in the storage compartment body 12.

In one example, the storage compartment bodies 11 and 12 may correspond, respectively, to a refrigerator compartment body 11 having a refrigerator compartment, and a freezer body 12 having a freezer compartment. Similarly, the doors 2A and 2B may correspond to a refrigerator compartment door(s) 2A for opening/closing the refrigerator compartment of the refrigerator compartment body 11, and a freezer compartment door(s) 2B for opening/closing the freezer compartment of the freezer body 12.

The refrigerator may further include a pantry (or pantry bin) 3 that separately accommodates objects, such as vegetables, meat, etc. In one example, the pantry 3 may be formed in a box shape. A pantry space (not shown) for separately keeping stored items, such as vegetable, meat, etc., may be defined in the pantry 3. The top of the pantry 3 may be open, such that the top of the pantry 3 includes an opening through which objects may be inserted or removed from the pantry.

The pantry 3 may be provided in one of the storage compartments S in the main body 1. The pantry 3 may be provided in the storage compartment body 11 having the refrigerator compartment or the storage compartment 12 having the freezer compartment.

The pantry 3 may be smaller in size than the storage compartment body 11. In one example, the pantry 3 may be provided within a storage compartment S to be cooled by air discharged through a sub-discharge port (or second port) 42 shown in FIG. 2. The pantry 3 may be provided in front of the sub-discharge port 42 or at a side from the sub-discharge port 42.

In one configuration, the pantry 3 may be used provided at the lower portion in the storage compartment S to be able to be drawn out forward. For example, the pantry 3 may be configured as a drawer. When the pantry 3 is provided in a storage compartment S of the storage compartment body 11, the pantry 3 may be provided between a top bottom plate of the storage compartment 11 and a lowermost shelve of a plurality of shelves 18, to be described below (see FIG. 1).

The refrigerator may further include a duct 4 for discharging air to the storage compartment S and the pantry 3. The duct 4 may be provided in the storage compartment body 11 and can discharge air to the storage compartment S in the storage compartment body 11.

The duct 4 may have a main discharge port (or first port) 41 for discharging air to the storage compartment S. The duct 4 may also have the sub-discharge port 42 for discharging air to the pantry 3. The sub-discharge port 42 may be spaced from the main discharge port 41.

The duct 4 may be provided in front of the rear plate of the storage compartment body 11, in which the main discharge port 41 and the sub-discharge port 42 may be open in the front-rear direction X. In other examples, the duct 4 may be provided to a right of the left plate of the storage compartment body 11 or to the left of the right plate of the storage compartment body 11, such that the main discharge port 41 and the sub-discharge port 42 may be open in a left-right direction Y (e.g., a horizontal along a plane at front opening of the main body 1).

The main discharge port 41 may be a discharge port for discharging air to the storage compartment S. The main discharge port 41 may be a storage compartment discharge port for mainly cooling a space within the storage compartment S and excluding the pantry 3 of the storage compartment S by discharging air to this portion of the of the storage compartment S outside for the pantry 3. The main discharge port 41 may be formed at a height where the main discharge port 41 does not horizontally face the pantry 3.

A plurality of main discharge port 41 may be formed at the duct 4. The main discharge ports 41 may be formed at different heights in the duct 4. The uppermost main discharge port provided at the highest position of the main discharge ports 41 may be formed closer to the top plate than the bottom plate of the storage compartment body 11. The lowermost main discharge port 41 provided at the lowest position of the main discharge ports 41 may be formed closer to the bottom plate than the top plate of the storage compartment body 11. The main discharge ports 41 may further include a middle main discharge port 41 provided between the uppermost main discharge port and the lowermost main discharge port.

The sub-discharge port 42 may be an exclusive discharge port for discharging air to the pantry 3. The sub-discharge port 42 may be provided lower than the main discharge port 41. For example, the sub-discharge port 42 may be formed at a height where it horizontally faces the pantry 3.

The refrigerator may further include a shelve 18 provided in the storage compartment S. A plurality of shelves 18 may be provided in a storage compartment S. The shelves 18 may be provided at heights where they do not block the main discharge port 41 and the sub-discharge port 42. The shelves 18 may be provided on the duct 4 such that the heights can be adjusted. A shelve holder 19 to which the shelves 18 are fixed may be formed in the duct 4. The shelve holder 19 may be vertically elongated in the duct 4.

The refrigerator may have an air suction port 43 for suctioning air from the storage compartment S and into the duct 4. The air suction port 43 may be formed at the duct 4 and may be formed between the duct 4 and the storage compartment body 11. The sub-discharge port 42 may be provided lower than the main discharge port 41 and the sub-discharge port 42. The air suction port 43 may be formed at a height where it is not blocked by the shelves 18 or the pantry 3.

In the refrigerator (e.g., the upper storage compartment body 11), the bottom of the pantry 3 may be spaced from the top of the bottom plate of the storage compartment body 11. The air suction port 43 may be formed at a height where it can face between the bottom of the pantry 3 and the bottom plate of the storage compartment body 11.

The air suction port 43 may be formed at the lower end of the duct 4. The air suction port 43 may be formed at a portion of the lower end of the duct 4. At least one air suction port 43 may be formed at the lower end of the duct 4. A plurality of air suction ducts 43 may be formed at the lower end of the duct 4 and may be horizontally spaced from each other at the lower end of the duct 4.

When the duct 4 is provided in front of the rear plate of the storage compartment body 11 and the sub-discharge port 42 is open in a front-rear direction X (e.g., perpendicular to a plane of a front opening of the main body 1) at the lower portion of the duct 4, the pantry 3 can be provided in front of the lower portion of the duct 4. On the other hand, when the duct 4 is provided at the right of the left plate or at the left of the right plate of the storage compartment body 11 and the sub-discharge port 42 is open in the left-right direction Y at the lower portion of the duct 4, the pantry 3 can be provided at a side from the lower portion of the duct 4. In the following description, the duct 4 is generally described as being provided in front of the rear plate of the storage compartment body 11, and the pantry 3 is described as being provided in front of the lower portion of the duct 4.

Figure 3:
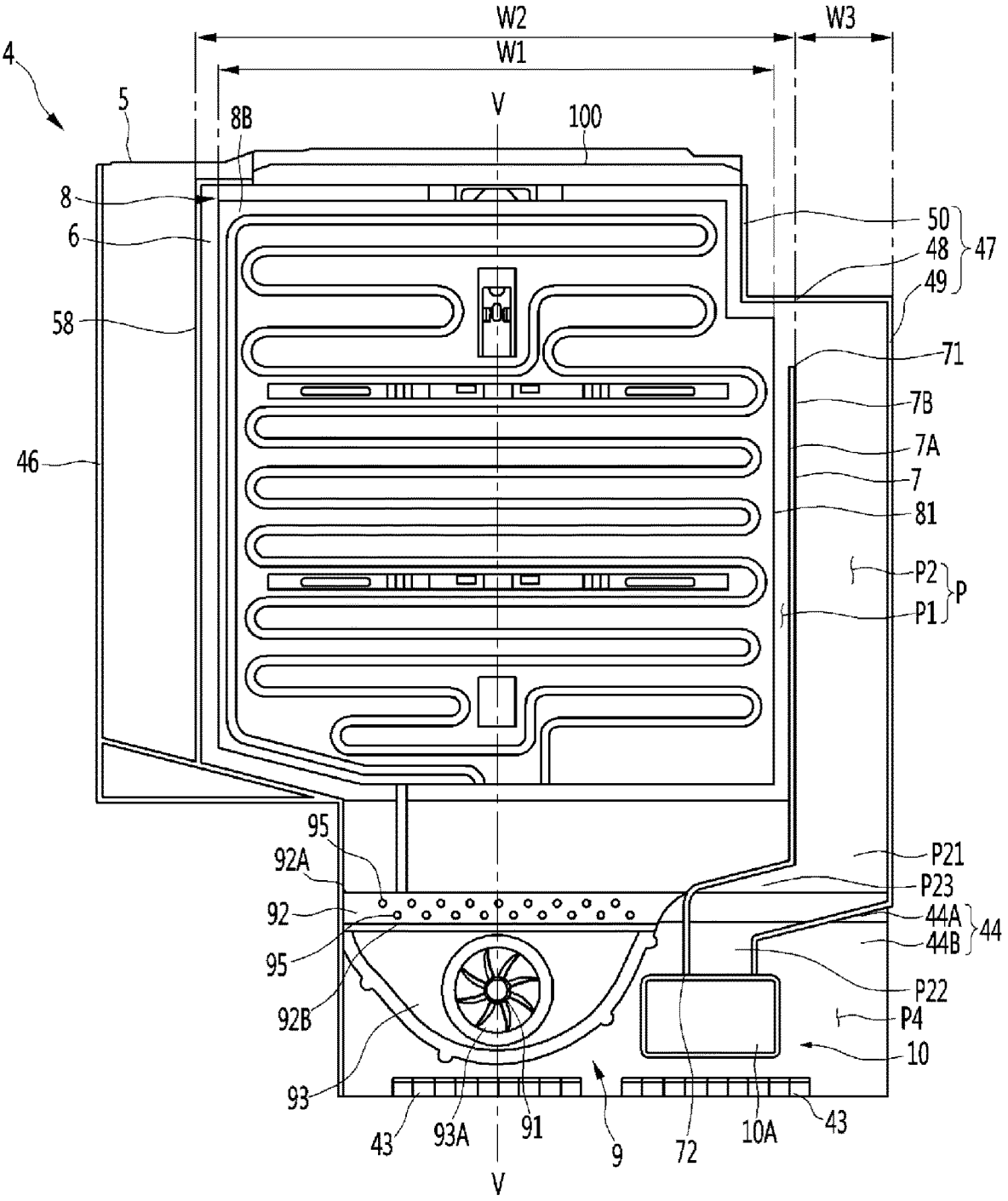
FIG. 3 is a rear view showing a duct, a heat exchanger, and a fan shown in FIG. 1.
Figure 4:
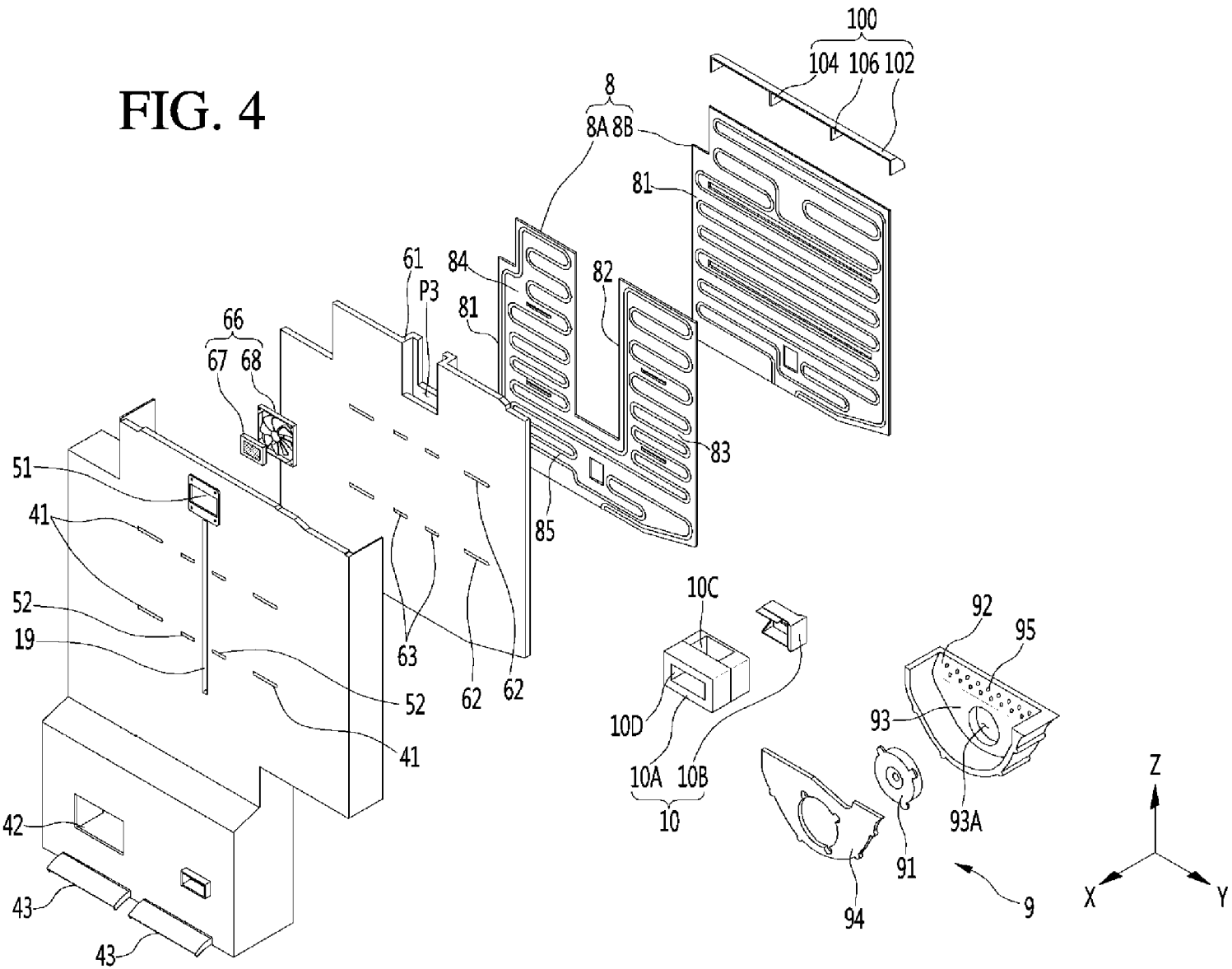
FIG. 4 is a front exploded perspective view showing the duct, heat exchanger, and fan of the refrigerator according to an embodiment of the present disclosure.
Figure 5:
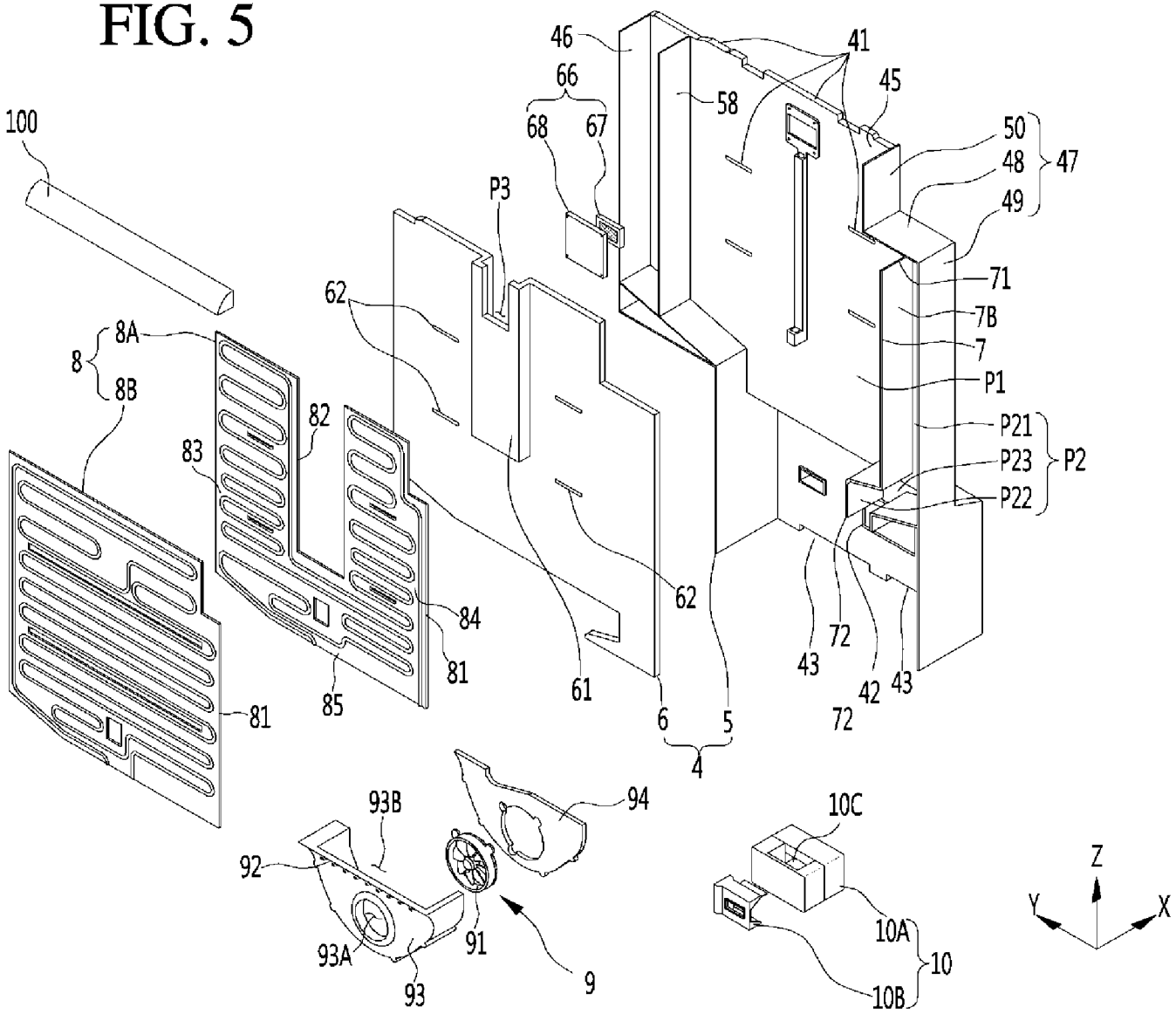
FIG. 5 is a rear exploded perspective view showing the duct, heat exchanger, and fan of the refrigerator according to an embodiment of the present disclosure.
Figure 6:
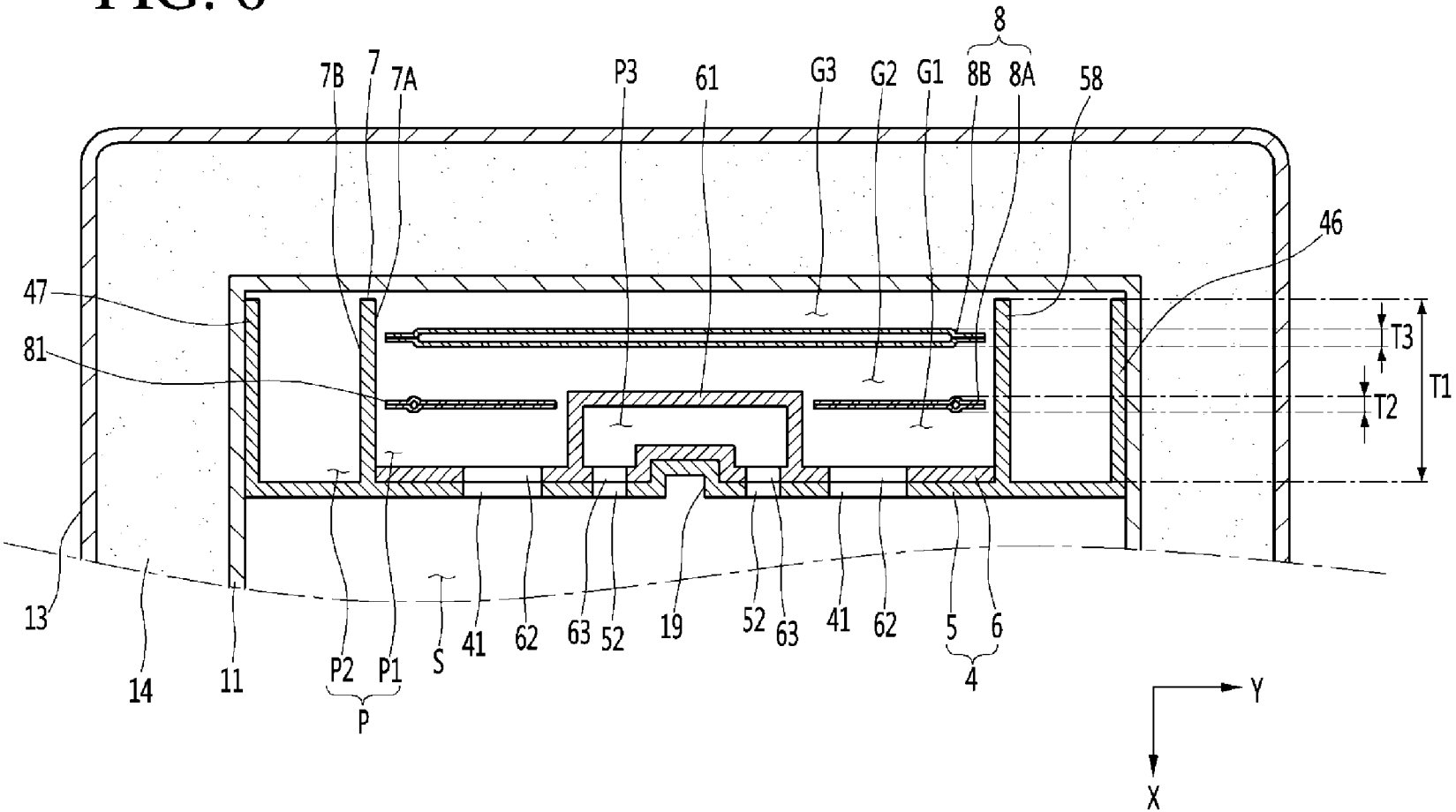
FIG. 6 is a horizontal cross-sectional view showing the duct and the heat exchanger of the refrigerator according to an embodiment of the present disclosure.
Figure 7:
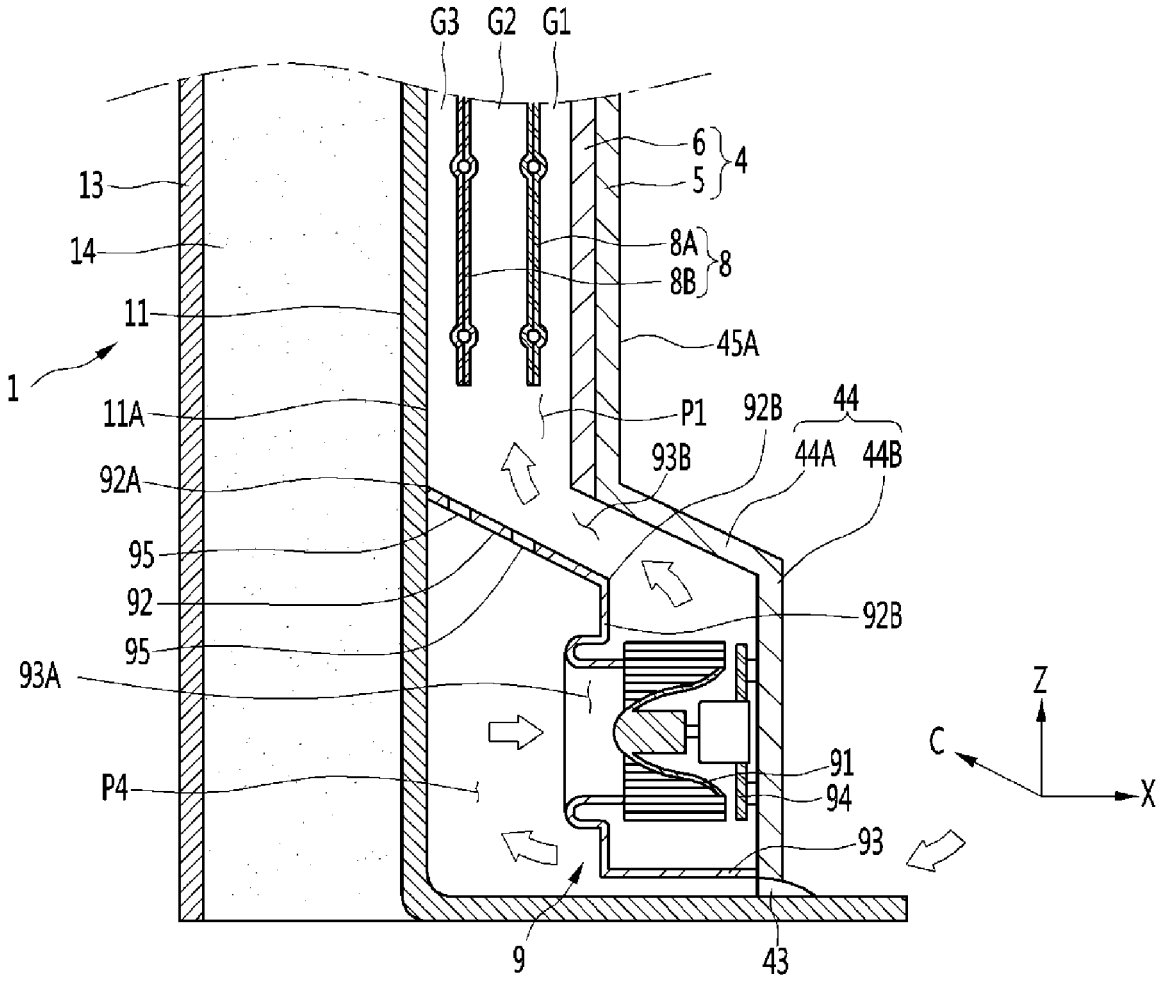
FIG. 7 is a vertical cross-sectional view showing the duct, heat exchanger, and fan of the refrigerator according to an embodiment of the present disclosure.

FIG. 3 is a rear view showing a duct, a heat exchanger, and a fan shown in FIG. 1, and FIG. 4 is a front exploded perspective view showing the duct, heat exchanger, and fan of the refrigerator according to an embodiment of the present disclosure. FIG. 5 is a rear exploded perspective view showing the duct, heat exchanger, and fan of the refrigerator according to an embodiment of the present disclosure, and FIG. 6 is a horizontal cross-sectional view showing the duct and the heat exchanger of the refrigerator according to an embodiment of the present disclosure. FIG. 7 is a vertical cross-sectional view showing the duct, heat exchanger, and fan of the refrigerator according to an embodiment of the present disclosure.

The refrigerator according to the present embodiment includes the duct 4, an air guide 7, a heat exchanger 8, and a fan 9. The duct 4, the air guide 7, the heat exchanger 8, and the fan 9 may be cold air suppliers that suction in and cools air in the storage compartment S and the discharge the cooled air back into the storage compartment S. The duct 4, the air guide 7, the heat exchanger 8, and the fan 9 may be provided in the storage compartment body 11 having the storage compartment S where the pantry 3 is provided.

In one configuration, the pantry 3 (see FIG. 1) may be provided in the refrigerator compartment, and the duct 4, the air guide 7, the heat exchanger 8, and the fan 9 may be provided in the storage compartment body 11 forming the refrigerator compartment. In this case, the duct 4 can separately discharge air to the refrigerator compartment and the pantry 3.

In another configuration, the pantry 3 may be provided in the freezer compartment, and the duct 4, the air guide 7, the heat exchanger 8, and the fan 9 may be provided in the storage compartment body 12 forming the freezer compartment. In this case, the duct 4 may separately discharge air to the freezer compartment and the pantry 3.

In another example, in the refrigerator, the duct 4, the air guide 7, the heat exchanger 8, and the fan 9 may be provided in each of the storage compartment bodies 11 and 12. Alternatively, in the refrigerator, the duct 4, the air guide 7, the heat exchanger 8, and the fan 9 may be provided in only any one of the storage compartment bodies 11 and 12 (e.g., in a compartment body 11 or 12 where the pantry 3 is positioned). In the following description, an example in which the pantry 3 is provided in the refrigerator compartment, and the duct 4, the air guide 7, the heat exchanger 8, and the fan 9 are provided in the storage compartment 11 having the refrigerator compartment will be described.

In the refrigerator, a freezer duct, a freezer evaporator, and a freezer fan may be separately provided in the storage compartment body 12 having the freezer compartment of the storage compartment bodies 11 and 12. The refrigerator may further include a refrigerant control valve that can separately supply a refrigerant condensed by a condenser to the heat exchanger 8 and the freezer evaporator. A first expansion device, such as an electronic expansion valve or a capillary valve that expands a refrigerant flowing toward the heat exchanger 8, may be provided between the refrigerant control valve and the heat exchanger 8. A second expansion device, such as an electronic expansion valve or a capillary valve that expands a refrigerant flowing toward the freezer evaporator, may be provided between the refrigerant control valve and the freezer evaporator.

The duct 4 is described in detail hereafter. The duct 4 can divide the inside of the storage compartment body 11 into a storage compartment S and an air channel P, as shown in FIG. 6. The main discharge port 41 and the sub-discharge port 42 may be both formed at the duct 4, as shown in FIGS. 4 and 5.

The main discharge port 41, as shown in FIG. 6, may be formed to face the storage compartment S and the air in the air channel P may be discharged to the storage compartment S through the main discharge port 41. The air in a first channel P1 (described below) of the air channel P can be discharged to the storage compartment S through the main discharge port 41 from the first channel P1.

The sub-discharge port 42 may be formed to face the pantry 3, and the air in the air channel P can be discharged to the pantry 3 through the sub-discharge port 42. Some of the air in the first channel P1 can be guided to a second channel P2 (described below) from the first channel P1, and as shown in FIG. 5, may flow toward the sub-discharge port 42 from the second channel P2.

A purification channel P3 (see FIG. 6) through which the air in the storage compartment S flows may be formed separately from the air channel P in the duct 4. A purification channel portion (or purification channel housing) 61 having the purification channel P3 may be further formed in the duct 4. The purification channel portion 61 can separate the purification channel P3 and the air channel P. The air suction port 61 may be formed a portion of the duct 4. The purification channel P3 and the air channel P may not directly communicate with each other.

Air suctioned into the purification channel P3 from the storage compartment S may flow through the purification channel P3 and then may be discharged to the storage compartment S through a purification discharge port 52 (see FIG. 6) without flowing to the air channel P from the purification channel P3. Similarly, the air suctioned into the air channel P from the storage compartment S may flow through the air channel P and then may be separately discharged to the storage compartment S and the pantry 3 through the main discharge port 41 and the sub-discharge port 42 without flowing into the purification channel P3 from the air channel P.

A purifying unit (or air purifier) 66 (see FIGS. 4 and 5) may be provided in the purification channel P3. The purifying 66 may include a filter unit (or filter) 67 provided in the purification channel P3. The filter unit 67 may be a sterilizing/pasteurizing filter that can kill and remove bacteria in the air. The purifying unit 66 may include a purification fan 68 that suctions air into the purification channel P3, directs the air to the filter unit 67, and sends the filtered air passing through the filter unit 67 to the storage chamber S through the purification channel P3. The filter unit 67 and the purification fan 68 may be mounted on the duct 4, particularly, on the purification channel portion 61.

The duct 4 may have a protrusive portion (or protrusion) 44 protruding forward at the lower portion of the duct. A space P4 (see FIG. 7) where the fan 9 and a damper 10 are accommodated may be defined between the protrusive portion 44 and the storage compartment body 11. A space P4 where the fan 9 and a damper 10 can accommodated may be defined between the rear side of protrusive portion 44 and the storage compartment body 11. The space P4 may be larger than the sum of the volume of the fan 9 and the volume of the damper 10. Referring to FIG. 7, the front-rear width (e.g., a width in the X direction) of the space P4 may be larger than the front-rear width of the fan 9 and the front-rear width of the damper 10.

Referring to FIG. 7, air from the storage compartment S can flow between the storage compartment body 11 and the protrusive portion 44 through the air suction port 43, and the air passing through the air suction port 43 can be suctioned to the fan 9 and, then, sent upward from the fan 9. The protrusive portion 44 may have an inclined portion (or inclined wall) 44A inclined with respect to a horizontal surface and a vertical surface. The protrusive portion 44 may have a vertical portion (or vwall) 44B vertically extending downward from the lower end of the inclined portion 44A. The duct 4 may have an upper vertical portion (or upper vertical wall) 45A provided in front of the heat exchanger 8 to cover the heat exchanger 8, the inclined portion 44*a* formed at the lower end of the upper vertical portion 45A, and the vertical portion 44B formed at the lower end of the inclined portion 44A.

The upper vertical portion 45A, the vertical portion 44B, and the inclined portion 44A may have steps or extensions in the front-rear direction. The inclined portion 44A can guide the air sent upward from the fan 9 to the first channel P1.

The duct 4 may be formed, for example, in a plate shape or a box (or rectangular) shape. When the duct 4 has a box shape, the duct 4 may include a front cover 45, a left cover 46 (see FIG. 6) protruding rearward from the left side of the front cover 45, and a right cover 47 (see FIG. 5) protruding rearward from the right side of the front cover 45. The front cover 45 may have the upper vertical portion (or upper vertical surface) 45A, and the inclined portion (or inclined surface) 44A and the vertical portion (or vertical surface) 44B of the protrusion part.

The left cover 46 and the right cover 47 may be spaced from each other in the left-right direction Y. The air channel P in which the heat exchanger 8 is accommodated and through which air can flow may be defined between the left cover 46 and the right cover 47. At least one of the left cover 46 and the right cover 47 may be bent at least once.

In the left cover 46 and the right cover 47, the cover 46, 47 closer to the air guide 7 may include an upper guide 48 and a side guide 49. The upper guide 48 may be spaced from the upper end 71 of the air guide 7 in the up-down direction Z. The upper end 71 of the air guide 7 may be spaced from the bottom of the upper guide 48 in the up-down direction Z under the upper guide 48, and the air in the first channel P1 may enter the second channel P2 through the gap between the upper end 71 of the air guide 7 and the bottom of the upper guide 48. The side guide 49 may be formed perpendicular to the upper guide 48 and may be horizontally spaced from the air guide 7. The side guide 49 may be spaced from the air guide 7 in the left-right direction Y.

In the left cover 46 and the right cover 47, the cover 46, 47 closer to the air guide 7 may include further include a vertical guide 50 perpendicular to the upper guide 48. The vertical guide 50 may be formed substantially in parallel with the air guide 7 and the other cover 46, 47 farther from the air guide 7 than the cover 46, 47 that includes vertical guide.

The air in the first channel P1 can enter the second channel P2 through an opening between the upper end 71 of the air guide 7 and the upper guide 48. The air entering the second channel P2 can flow downward from the open between the side guide 49 and the opposite side 7B of the air guide 7, which is opposite to the side 7A of the air guide 7 facing the heat exchanger 8.

The duct 4 may further include an inner guide 58 horizontally spaced from the air guide 7 and forming the first channel P1 together with the air guide 7. The inner guide 58 may be at least partially parallel with the air guide 7. That is, the duct 4 may have the first channel P1, in which the heat exchanger 8 is provided, between the inner guide 58 and the air guide 7, and the duct 4 may also have the second channel P2 formed between the air guide 7 and the right cover 47.

The duct 4 may be a single insulating member or may be an assembly formed through a plurality of members. When the duct 4 includes a plurality of members, the duct 4 may include, for example, a duct cover 5 and an insulator 6, as shown in FIGS. 4 to 6.

The duct cover 5 may be an outer duct component, and the front side of the duct cover 5 may be exposed to the storage compartment S such that a part of the front side of the duct cover 5 may be seen from the outside when the door 2 is open. As previously described, the duct cover 5 may include the front cover 45, the left cover 46, and the right cover 47.

The main discharge port 41 and the sub-discharge port 42 may be formed on the duct cover 5. A purification suction hole 51 and a purification discharge hole 52 that communicate with the purification channel P3 may also be formed at the duct cover 5, as shown in FIG. 5.

The insulator 6 may be an inner duct component that is covered by the duct cover 5. In one example, the insulator 6 may contact the inner side of the duct cover 5 to help prevent the duct cover 5 from freezing due to a heat exchange with the heat exchanger 8.

The purification channel portion 61 may protrude rearward on the insulator 6. Inner discharge holes 62 that communicate with the main discharge port 41 may be formed at the insulator 6. Referring to FIG. 6, some of the air passing through the first channel P1 can be discharged to the storage compartment S through the inner discharge holes 62 of the insulator 6 and the main discharge port 41 of the duct cover 5. An inner purification discharge hole 63 that communicates with the purification discharge hole 52 of the duct cover 5 and through which the air in the purification channel P3 passes may be formed at the insulator 6.

The air guide 7 is described in detail hereafter. As previously described, the air guide 7 may divide the air channel P into the first channel P1 and the second channel P2. The first channel P1 may be a channel communicating with the main discharge port 41. The second channel P2 may be a channel that guides the air in the first channel P1 to the sub-discharge port 42. The air guide 7, which divides the inside of the duct 4 into the first channel P1 and the second channel P2, may be formed in the duct 4 and or the storage compartment body 11.

The air guide 7, as shown in FIGS. 2 and 5, may extend in the up-down direction Z in the duct 4, thereby to separate the first channel P1 to the left and the second channel P2 to the right (when viewed through the front of the main body). The air guide 7 may be formed in the duct 4, and, as shown in FIG. 6, it may protrude rearward from one of the duct cover 5 or the insulator 6.

Referring to FIG. 6, the front-rear width T1 of the air guide 7 may be larger than the front-rear widths T2 and T3 of the heat exchanger 8. When the refrigerator includes one heat exchanger 8, the front-rear width T1 of the air guide 7 may be larger than the front-rear width of the heat exchanger 8. When the refrigerator includes a plurality of heat exchangers 8A and 8B, the front-rear width T1 of the air guide 7 may be larger than the sum of the widths of the heat exchangers 8A and 8B. The front-rear width T1 of the air guide 7 may be larger than the gap G2 between the heat exchangers 8A and 8B and the sum T2+T3 of the widths T2 and T3 of the heat exchangers 8A and 8B.

The front-rear width T1 of the air guide may be larger than the sum (G1+G2+G3) of the gap G1 between the duct 4 and the front heat exchanger 8A, the gap G2 between the front heat exchanger 8A and the rear heat exchanger 8B, and the gap G3 between the rear heat exchanger 8B and the storage compartment body 11.

Referring to FIGS. 3 and 5, the upper end 71 of the air guide 7 may be closer to the upper end than the lower end of the duct 4. The upper end 71 of the air guide 7 may be spaced from the left cover 46 and the right cover 47. The lower end 72 of the air guide 7 may be closer to the lower end than the upper end of the duct 4. The lower end 72 of the air guide 7 may extend over the upper end of a damper 10, to be described below. The lower end 72 of the air guide 7 may be in contact with the top of the damper 10.

The heat exchanger 8 is described in detail hereafter. The heat exchanger 8 may be provided in the storage compartment body 11 and can function to cool the storage compartment S. The heat exchanger 8 may be a TEM or an evaporator through which a refrigerant evaporates to exchange heat with the surrounding air to cool the heat exchanger 8.

When the heat exchanger 8 is an evaporator, the refrigerator may further include a compressor that compresses a refrigerant, a condenser (not shown) that condenses the refrigerant compressed by the compressor, and an expansion device that expands the refrigerant condensed through the condenser, such as an electronic expansion valve or a capillary valve.

When the heat exchanger 8 is an evaporator, the heat exchanger 8 may be connected to the expansion device through an expansion device connection tube and connected to the compressor through a compressor connection tube. The heat exchanger 8 may be provided in the air channel P, particularly, the first channel P1. The refrigerant expanded by the expansion device can vaporize by absorbing the heat of the air passing through the first channel P1. The refrigerant vaporizing through the heat exchanger 8 can be suctioned into the compressor and compressed at high temperature and high pressure.

When the heat exchanger 8 is a TEM, the heat exchanger may include a cooling plate that functions as a low-temperature part and a heat dissipation plate that functions as a high-temperature part, the cooling plate of the TEM may be provided in the air channel, particularly, the first channel P1, and the heat dissipation plate may be provided outside the air channel of the main body 1. The air passing through the first channel P1 can be cooled by the cooling plate and the heat transferring to the cooling plate can be discharged to the outside through the heat dissipation plate In the following discussion, the heat exchanger 8 is described as an evaporator, but it should be appreciated that the heat exchanger 8 may be a TEM. When the heat exchanger 8 is an evaporator, the heat exchanger 8 may be, for example, a fin tube heat exchanger having pins attached to a refrigerant tube, or a roll bond heat exchanger having a pair of electric heat plates bonded to each other and having a refrigerant channel formed between the electric heat plates.

The roll bond heat exchanger may be thinner than the fin tube heat exchanger. When the refrigerator includes a roll bond heat exchanger instead of the fin tube heat exchanger, the thickness (that is, the front-rear width) of the air channel P can be made small and the volume of the storage compartment S (that is, the front-rear width of the storage compartment) can be relatively increased.

The heat exchanger 8 may be positioned in the first air channel P1. The heat exchanger 8 may be provided only in the first channel P1, not in the second channel P2. The first channel P1 may be a heat exchanger receiving cavity in which the heat exchanger 8 is accommodated, and air flowing to the first channel P1 can exchange heat with the heat exchanger 8 while passing through the first channel P1.

Referring to FIG. 6, a side 81 of the heat exchanger 8 may face the air guide 7 in the left-right direction Y. In particular, the side 81 of the heat exchanger 8 may face the inner surface 7A of the air guide 7. For example, one side 81 located at a left or a right side of the heat exchanger 8 can face the air guide 7 in the left-right direction Y, and other side of the heat exchanger 8 can face the inner guide 58.

The horizontal width W1 of the heat exchanger 8 may be smaller than the horizontal width W2 of the first channel P1 such that the heat exchanger 8 may fit in the channel P1. The horizontal width W3 of the second channel P2 may be smaller than the horizontal width W1 of the heat exchanger 8. As used herein, the horizontal width W1 of the heat exchanger 8 may be the width of a widest portion of the heat exchanger 8. Similarly, the horizontal width W2 of the first channel P1 may be a width at the widest portion of the first channel P1. Likewise, the horizontal width W3 of the second channel P2 may be the width of a widest portion of the second channel P2 is the largest.

The second channel P2 may not overlap the heat exchanger 8 in the front-rear direction X. When the horizontal width W3 of the second channel P2 is smaller than the horizontal width W1 of the heat exchanger 8, the heat exchanger 8 may be arranged to have a relatively large area between the duct 4 and storage compartment body 11.

The left-right width W1 of the heat exchanger 8 may be smaller than the left-right width W2 of the first channel p1 and larger than the left-right width W3 of the second channel P2, and the heat exchanger 8 may be arranged to have a relatively large area between the duct 4 and the storage compartment body 11.

One heat exchanger 8 may be provided in the duct 4, or a plurality of heat exchangers 8A and 8B may be provided in the duct 4. When the refrigerator includes a plurality of heat exchangers 8A and 8B, a bypassing portion 82 that bypasses the purification channel portion 61 may be formed in at least one of the heat exchangers 8A and 8B. The purification channel portion 61 may have a polygonal, such as rectangular, outer shape, and the bypassing portion 82 may be formed in the polygonal shape corresponding to the shape the purification channel portion 61. In one example, the purification channel portion 61 may have a hexahedral shape that is long in the up-down direction Z and the bypassing portion 82 may be an opening that is long in the up-down direction Z. The bypassing portion 82 may be larger in area than the purification channel portion 61.

When the refrigerator includes a plurality of heat exchangers 8A and 8B, the refrigerator may include the front heat exchanger 8A and a rear heat exchanger 8B. The front heat exchanger 8A may be spaced from the duct 4 in the front-rear direction. The rear heat exchanger 8B may be spaced from the front heat exchanger 8A and the storage compartment body 11 in the front-rear direction X.

A refrigerant tube may be connected to each of the front heat exchanger 8A and the rear heat exchanger 8B. In the refrigerator, the refrigerant tubes connected to the front heat exchanger 8A and the rear heat exchanger 8B may connect the front heat exchanger 8A and the rear heat exchanger 8B to each other in series or may connect the front heat exchanger 8A and the rear heat exchanger 8B to each other in parallel.

When the refrigerator includes a plurality of heat exchangers 8, the refrigerator may further include a center heat exchanger (not shown) provided between the front heat exchanger 8A and the rear heat exchanger 8B. The center heat exchanger may be spaced from the front heat exchanger 8A and the rear heat exchanger 8B. A plurality of center heat exchangers may be provided between the front heat exchanger 8A and the rear heat exchanger 8B, and in this case, the center heat exchangers may be spaced from each other in the front-rear direction. In the refrigerator, the number of heat exchangers spaced from each other in the front-rear direction is not limited, and in one example, two (e.g., having no center heat exchangers) to five (e.g., having three center heat exchangers) heat exchangers 8 may be used.

A bypassing portion (or bypassing region) 82 that bypasses the purification channel portion 61 may be formed in at least one of the heat exchangers 8A and 8B. The sum of the areas of the heat exchangers 8A and 8B may be larger than the area of the duct 4. In one example, t bypassing portion 82 that bypasses the purification channel portion 61 may be formed in the front heat exchanger 8A. For example, the front heat exchanger 8A may include a left heat exchanging part provided at the left side from the purification channel portion 61, a right heat exchanging part 84 provided at the right side from the purification channel portion 61, and a bottom heat exchanging part 85 connecting the lower end of the left heat exchanging part 83 and the lower end of the right heat exchanging part 84.

The bypassing portion 82 may be positioned between the left heat exchanging part 83 and the right heat exchanging part 84. A portion of the bottom heat exchanging part 85 may be positioned under the bypassing portion 82. The left heat exchanging part 83 and the right heat exchanging part 84 may be spaced from each other in the left-right direction with the bypassing portion 82 therebetween. The distance between the left heat exchanging part 83 and the right heat exchanging part 84 may be longer than the left-right width of the purification channel portion 61.

The front heat exchanger 8A may be provided to substantially surround the left side, the lower portion, and the right side of the purification channel portion 61. The front heat exchanger 8A may be smaller in area than the rear heat exchanger 8B. The sum of the areas of the front heat exchanger 8A and the rear heat exchanger 8B may be larger than the area of the duct 4. In one implementation, the heat exchangers 8A and 8B have a maximum heat transfer area without interfering with the purification channel portion 61. Further, as described above, the bypassing portion 82 may be formed in the heat exchanger 8A closer to the duct 4 in the front-rear direction X, and the bypassing portion 82 may not formed in the heat exchanger 8B farther from the duct 4 in the left-right direction X.

In one embodiment, the bypassing portion 82 may be formed in both of the heat exchangers 8A and 8B, such that the bypassing portion 82 is not formed only in one of the heat exchangers 8A and 8B. When the bypassing portion 82 is formed in only one of the heat exchangers 8A and 8B, the sum of the areas of the purification channel portion 61 and the front heat exchanger 8A may be smaller than the area of the rear heat exchanger 8B.

A gap may exist between the purification channel portion 61 and the front heat exchanger 8A and the gap may face the front side of the rear heat exchanger 8B. For example, the rear heat exchanger 8B may have a first section facing the front heat exchanger 8A in the front-rear direction X, a second section facing the purification channel portion 61 in the front-rear direction X, and a third section facing the gap between the purification channel portion 61 and the front heat exchanger 8A in the front-rear direction X. The third section may be positioned between the first section and the second section. Even though the purification channel P3 may be formed by the bypassing portion 82 in the refrigerator, it is possible to minimize the horizontal thickness of the duct 4 and maximize the volume of the storage compartment S.

The fan 9 is described in detail hereafter. The fan 9 can suction the air in the storage compartment S and direct the air to the first channel P1. The fan 9 may include a fan motor 91 and a fan housing 93. The fan 9 may further include a fan motor bracket 94 on which the fan motor 91 is mounted.

The fan housing 93 can surround the outer side of the fan motor 91 and may have a discharge guide 92 protruding from the upper portion toward the heat exchanger 8. The fan housing 93 may have an air suction hole 93A through a side to face the storage compartment body 11 and an air discharge hole 93B at a top. The air suction hole 93A of the fan housing 93 may be formed though the rear side of the fan housing 93, so air can be suctioned into the fan housing 93 through the rear side of the fan housing 93 and can be discharged through the top of the fan housing 93.

A discharge guide 92 may be spaced from the heat exchanger 8 under the heat exchanger 8 and may have a top facing the heat exchanger 8. The discharge guide 92 may be inclined with respect to the horizontal surface and the vertical surface. The discharge guide 92 may be inclined toward the storage compartment body 11 as it goes upward. The discharge guide 92 may be spaced from the inclined portion 44A of the protrusive portion 44 in the front-rear direction X, and the air sent from the fan motor 91 may be sent upward after passing through between the inclined portion 44A and the discharge guide 92 at an angle.

The discharge guide 92 can guide air, together with the inclined portion 44A of the protrusive portion 44. An inclined channel that guides the air sent upward from the fan 9 rearward and upward in an inclined direction C may be formed between the discharge guide 92 and the inclined portion 44A. In the discharge guide 92, as shown in FIG. 7, the top may face the first channel P1 in the up-down direction Z and the bottom may face the space P4 between the storage compartment body 11 and the protrusion portion 44.

The upper end 92A of the discharge guide 92 may be in contact with the inner side 11A of the storage compartment body 11. The lower end 92B of the discharge guide 92 may be spaced from the protrusive portion 44 in the up-down direction Z and the front-rear direction X.

The lower end 92B of the discharge guide 92 may fit to the inclined portion 44A in the up-down direction Z. The lower end 92B of the discharge guide 92 may be positioned under the bottom of the inclined portion 44A. In this case, condensate water falling down from the heat exchanger 8 may fall down to the discharge guide 92 provided under the first channel P1, whereby it is possible to minimize the condensate water falling down to the fan motor 91 after falling down to the heat exchanger 8.

A defrost water hole 95 may be formed at the discharge guide 92. The defrost water dripping from the heat exchanger 8 may fall down to the top of the discharge guide 92 and may flow into the defrost water drain hole 95 while flowing on the top of the discharge guide 92. Further, the defrost water flowing in the defrost water drain hole 95 may pass through the defrost water drain hole 95 without flowing to the fan motor 91 and may fall down to the bottom plate of the storage compartment body 11 through the space P4 between the storage compartment body 11 and the protrusive portion 44. At least one defrost water drain hole 95 may be formed at the discharge guide 92. In one implementation, a plurality of defrost water holes 95 are formed at the discharge guide 92.

The condensate water falling down from the heat exchanger 9 may flow down to the top of the discharge guide 92 due to gravity. The condensate water flowing on the top of the discharge guide 92 may fall down to the space P4 between the storage compartment body 11 and the protrusive portion 44 through the defrost water drain hole 95. For example, the discharge guide 92 may be an air guide that can guide the air sent from the fan motor 91 to the first channel P1 and may be a defrost water guide that can guide defrost water to the defrost water drain hole 95.

In the refrigerator, the fan housing 93 may also functions as a defrost water collection member, so as to minimize a number of parts and simplify the assembly process, in comparison to configuration in which a separate defrost water collection member is used with the fan housing 93.

The refrigerator may further include the damper 10 that control the air that is discharged to the sub-discharge port 42 from the second channel P2. The fan 9, damper 10, and second channel P2 are described in detail hereafter.

The damper 10 may connect the lower end of the second channel P2 to the sub-discharge port 42. The damper 10 may include a damper case 10A and a damper module (or damper passage cover) 10B coupled to the damper case 10A. The damper 10 may have an inlet 10C through which air flows inside from the second channel P2 and an outlet 10D through which the air flowing in the inlet 10C is discharged toward the pantry 3. The inlet 10C and outlet 10D may be formed at the damper case 10A. The inlet 10C may be formed through the top of the damper case 10A to be open in the up-down direction Z. The outlet 10D may be formed through the front side of the damper case 10A to be open in the front-rear direction X.

A damper passage that communicates with the inlet 10C and outlet 10D may be formed in the damper case 10A. The damper module 10*b* may be provided in the damper case 10A. The damper module 10B may include a shutter that can open/close the damper passage of the damper case 10A and a motor that rotates the shutter. In a closing mode of the damper 10, the motor of the damper module 10B can rotate the shutter to block the damper passage with the shutter. In contrast, in an opening mode of the damper 10, the motor of the damper module 10B can rotate the shutter in a reverse direction and out of the damper passage such that the shutter does not block the damper passage.

The positions of the sub-discharge port 42 and the damper 10 may depend on the position of the pantry 3. In one implementation, the sub-discharge port 42 and the damper 10 can help minimize the volume of the storage compartment S by being positioned close to or at a center of the pantry 3.

The horizontal maximum width of the fan 9 may be smaller than the horizontal maximum width of the heat exchanger 8 and the fan 9 may be positioned on a vertical central axis V of the duct 4 to be able to uniformly send air to the heat exchanger 8. The spaces left and right of the fan 9 may be spaces where the heat exchanger 8 is not provided, and the damper 10 may be provided at a side of the fan 9.

The damper 10, as shown in FIG. 3, may be provided at the left side or the right side of the fan 9. The sub-discharge port 42, as shown in FIG. 2, may be biased to the left or the right of the vertical central axis V (see FIG. 3) of the duct 4.

The fan 9 and the damper 10 may be provided at the protrusive portion 44. The fan 9 and the damper 10 may be provided in the protrusive portion 44. For example, the fan 9 and the damper 10 may be accommodated in the space P4 defined in the protrusive portion 44.

The fan 9 and the damper 10 may be spaced from each other in the horizontal direction between the protrusive portion 44 and the storage compartment body 11. However, when the sub-discharge port 42 and the damper 10 are positioned relatively too close to one of the left plate or the right plate of the storage compartment body 11, the air passing through the damper 10 may excessively concentrate on one of the left and right side of the pantry 3. Accordingly, in one implementation, the sub-discharge port 42 and the damper 10 may be positioned at or near the vertical central axis V of the duct 4 without the damper 10 interfering with the fan 9.

The damper 10 may be provided close to the fan 9 at a side from the fan 9, and to this end, the second channel P2 may be bent at least once. In one implementation, the second channel P2 may be positioned close to or at one of the left plate or the right plate of the storage compartment body 11 so that the duct 4 has sufficient space to receive the heat exchanger 8 having a sufficient area. In one implementation, the second channel P2 may be formed as close to or at one of the left plate or the right plate of the storage compartment body 11 such that only a portion close to the damper 10 is close to the fan 9.

To this end, the second channel P2 may have an upper channel p21, a lower channel P22, and an inclined channel P23. The upper channel P21 may be positioned at a side from the first channel P1. The lower channel p22 may be positioned over the damper 10. The lower channel P22 may not overlap the upper channel P21 in the up-down direction Z.

The lower channel P22 may not generally overlap the upper channel P21 in the up-down direction Z. The lower channel P22 may partially overlap the upper channel p21 in the up-down direction, and in this case, it is preferable that the area of the portion, which does not overlap the upper channel P21 in the up-down direction Z, of the lower channel P22 is larger than the area of the portion overlapping the upper channel P21 in the up-down direction Z.

The inclined channel P23 may communicate with the upper channel p21 and the lower channel P22. The upper end of the inclined channel P23 may communicate with the lower end of the upper channel P21 and the lower end of the inclined channel P23 may communicate with the upper end of the lower channel P22.

Some of the air in the first channel P1 may enter the upper channel P21 from the upper portion of the first channel p1 and may be vertically guided along the upper channel P21. The air that has passed through the upper channel P21 may be changed in the flow direction at an angle while being guided along the inclined channel P23. The air that has passed through the inclined channel P23 may be changed vertically in the flow direction while being guided along the lower channel P22, whereby, consequently, the air can flow into the damper 10 from the lower channel P22.

On the other hand, the refrigerator may further include an upper guide 100 that changes forward the flow direction of the air sent to the upper portion of the first channel P1. The upper guide 100 is described hereafter. The upper guide 100 may be formed to guide air to the main discharge port positioned at the highest position of a plurality of main discharge ports 41.

The upper guide 100 may include a channel guide 102 bent between a rear plate and a top plate. The upper guide 100 may further include a pair of ribs 104 and 106 that guides the air suctioned into the purification suction hole 51 to the purification channel P3 in contact with the purification channel portion 61.

The operation of the present embodiment is described hereafter. First, when the fan 9 is operated, the air in the storage compartment S can be suctioned into the space P4 between the duct 4 and the storage compartment body 11 through the air suction hole 43. The air can be suctioned into the fan housing 93 through the air suction hole 93A and can be discharged through the air discharge hole 93B. The air discharged through the air discharge hole 93B can enter the first channel P1 through between the discharge guide 92, and the inclined portion 44*b* and can exchange heat with at least one of the heat exchangers 8A and 8B while passing through the first channel P1.

When the refrigerator includes a plurality of heat exchangers 8A and 8B, the air in the first channel P1 can exchange heat with the heat exchangers 8A and 8B while passing through the gap G1 between the front heat exchanger 8A and the duct 4, the gap G2 between the front heat exchanger 8A and the rear heat exchanger 8B, and the gap G3 between the rear heat exchanger 8B and the storage compartment body 11. The air that has exchanged heat with the heat exchangers 8A and 8B can be guided to the upper portion of the first channel P1 along the first channel P1.

When the fan 9 is operated, the damper 10 may be in the opening mode, in which some of the air sent to the upper portion of the first channel P1 may enter the second channel P2 and may be guided along the second channel P1, but the air not flowing to the second channel P2 may be discharged to the storage compartment S through the main discharge port 41.

The air entering the second channel P2 and guided to the second channel P2 may be guided downward along the second channel P2 and then flow into the damper 10. Further, the air may be discharged through the sub-discharge port 42 after passing through the damper 10. The air discharged to the sub-discharge port 42 may be sent to the pantry 3 and may cool the pantry 3.

When the refrigerator further includes the purification channel portion 61 and the purifying unit 61, and the purification fan 68 of the purifying unit 66 is operated, some of the air in the storage compartment S may be suctioned into the purification channel P3 through the purification suction hole 51 and bacteria in the air may be killed/removed while the air suctioned into the purification channel P3 passes through the filter unit 67. The sterilized/pasteurized air may be discharged to the storage chamber S through the purification discharge hole 52 after passing through the purification channel P3.

Aspects of the present disclosure provide a refrigerator of which the volume of a storage compartment can be maximized and that can separately discharge air that has exchanged heat with a heat exchanger, using a simple structure.

In some implementations, a refrigerator according to an embodiment of the present disclosure includes: a duct dividing the inside of a storage compartment body into a storage compartment and an air channel and having a main discharge port and a sub-discharge port; an air guide dividing the air channel into a first channel communicating with the main discharge port and a second channel guiding air in the first channel to the sub-discharge port; a heat exchanger provided in the first channel; and a fan suctioning air in the storage compartment and sending the air to the first channel.

The horizontal width of the heat exchanger may be smaller than the horizontal width of the first channel. The horizontal width of the second channel may be smaller than the horizontal width of the heat exchanger. A side of the heat exchanger may face the air guide in a left-right direction. The second channel may not overlap the heat exchanger in a front-rear direction.

The air guide may be elongated in an up-down direction in the duct, thereby separating the first channel and the second channel. The front-rear width of the air guide may be larger than the front-rear width of the heat exchanger. The refrigerator may further include a pantry cooled by air discharged through the sub-discharge port. The pantry may be provided in the storage compartment. The refrigerator may further include a damper controlling air discharged to the sub-discharge port from the second channel.

The sub-discharge port may be formed lower than the main discharge port. The sub-discharge port may be biased to one of left and right side from a vertical central axis of the duct. The damper may be provided at a side from the fan.

The duct may have a protrusive portion protruding forward at the lower portion. The fan and the damper may be provided in the protrusive portion. The fan and the damper may be provided between a storage compartment body and the protrusive portion.

The second channel may include: an upper channel positioned at a side from the first channel; a lower channel positioned over the damper and not overlapping the upper channel in the up-down direction; and an inclined channel connecting the upper channel and the lower channel to each other.

A plurality of heat exchangers may be provided between the duct and the storage compartment body. The heat exchangers may be spaced from each other in the front-rear direction. At least one of the heat exchangers may have a bypassing portion that bypasses the purification channel portion. The heat exchangers may include a front heat exchanger and a rear heat exchanger spaced from the front heat exchanger and the storage compartment in the front-rear direction.

The front heat exchanger may be spaced from the duct in the front-rear direction. The front heat exchanger may have a bypassing portion. The front-rear width of the air guide may be larger than the sum of a gap between the duct and the front heat exchanger, a gap between the front heat exchanger and the rear heat exchanger, and a gap between the rear heat exchanger and a storage compartment body.

The front heat exchanger may have a bypassing portion that bypasses the purification channel portion. The area of the front heat exchanger may be smaller than the area of the rear heat exchanger. The sum of the areas of the front heat exchanger and the rear heat exchanger may be larger than the area of the duct.

The duct may further include a purification channel portion having a purification channel through which air in the storage compartment passes. A purifying unit may be provided in the purification channel. The duct may include a duct cover and an insulator. The duct cover may have the main discharge port and the sub-discharge port and may have a purification suction hole and purification discharge hole that communicate with the purification channel.

The insulator may have an inner discharge hole communicating with the main discharge port. The purification channel portion may protrude rearward from the insulator. The fan may include: a fan motor; and a fan housing surrounding the outer side of the fan motor and having a discharge guide integrally protruding at the upper portion to face the first channel. The discharge guide may be positioned under the first channel and inclined. The discharge guide may have a defrost water drain hole.

According to an embodiment of the present disclosure, it is possible to separately discharge air, which has exchanged heat with a heat exchanger, to a main discharge port and a sub-discharge port from a first channel, using a simple configuration of an air guide, and the air separately discharged to the main discharge port and the sub-discharge port can 3-dimensionally cool a storage compartment.

Further, the heat transfer area between a refrigerant and air can be maximized by a plurality of heat exchangers, the front-rear width of a first channel can be minimized by a bypassing portion, the performance of cooling a storage compartment can be maximized, and the volume of the storage compartment can be maximized.

Further, since a damper is provided at a side from a fan, so a compact configuration can be achieved and the volume of the storage compartment can be maximized. Further, since the discharge guide of the fan housing has a defrost drain hole, it is possible to reduce the number of parts and simplify the assembly process, as compared with a case when a separate defrost water collection member for draining defrost water is combined with a fan housing.

The above description merely explains the spirit of the present disclosure and the present disclosure may be changed and modified in various ways without departing from the spirit of the present disclosure by those skilled in the art. Accordingly, the embodiments described herein are provided merely not to limit, but to explain the spirit of the present disclosure, and the spirit of the present disclosure is not limited by the embodiments. The protective range of the present disclosure should be construed by the following claims and the scope and spirit of the disclosure should be construed as being included in the patent right of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a duct that divides an inside of the refrigerator into a storage compartment and an air channel, the duct having a first port and a second port;

an air guide that divides the air channel into a first channel communicating with the first port and a second channel guiding air in the first channel to the second port;

a heat exchanger provided in the first channel; and a fan that suctions in air from the storage compartment and outputs the air to the first channel, wherein the duct includes a duct cover in which the first port and the second port are formed and an insulator having an inner discharge hole communicating with the first port, wherein the duct cover includes a front cover, a first side cover and a second side cover, the first and second side covers being protruded rearward from the front cover, wherein the second channel is formed between the air guide and the second side cover, and wherein the second side cover includes an upper guide spaced vertically from an upper end of the air guide and a side guide spaced horizontally from the air guide, to allow the air in the first channel to enter the second channel through between the upper end of the air guide and the upper guide and to flow through between the side guide and the air guide.

2. The refrigerator of claim 1, wherein a horizontal width of the heat exchanger is smaller than a horizontal width of the first channel, and a horizontal width of the second channel is smaller than the horizontal width of the heat exchanger.

3. The refrigerator of claim 1, wherein a side of the heat exchanger faces the air guide in a left-right direction, and the second channel does not overlap the heat exchanger in a front-rear direction.

4. The refrigerator of claim 1, wherein the air guide is elongated in an up-down direction in the duct and separates the first channel and the second channel.

5. The refrigerator of claim 1, wherein a front-rear width of the air guide is larger than a front-rear width of the heat exchanger.

6. The refrigerator of claim 1, further comprising:

a pantry bin provided in the storage compartment and positioned to be cooled by air discharged through the second port; and a damper that controls air discharged to the second port from the second channel, wherein the second port is biased to one of left or right side from a vertical central axis of the duct.

7. The refrigerator of claim 6, wherein the damper is provided at a side of the fan.

8. The refrigerator of claim 6, wherein the duct includes a protrusion that extends forward at a lower portion, and the fan and the damper are provided in the protrusion.

9. The refrigerator of claim 6, wherein the second channel includes:

an upper channel positioned at a side of the first channel;

a lower channel positioned over the damper and not overlapping the upper channel in an up-down direction; and an inclined channel connecting the upper channel and the lower channel.

10. The refrigerator of claim 1, wherein the heat exchanger includes:

a front heat exchanger spaced from the duct in an front-rear direction; and a rear heat exchanger spaced from the front heat exchanger and the storage compartment in the front-rear direction.

11. The refrigerator of claim 10, wherein a front-rear width of the air guide is larger than a sum of a width of a gap between the duct and the front heat exchanger, a width of a gap between the front heat exchanger and the rear heat exchanger, and a width of a gap between the rear heat exchanger and a storage compartment body.

12. The refrigerator of claim 10, wherein the duct further includes a purification channel housing defining a purification channel through which air in the storage compartment passes, an air purifier is provided in the purification channel, and the front heat exchanger has a bypassing region that bypasses the purification channel.

13. The refrigerator of claim 12, wherein the duct cover is formed with a purification suction hole and purification discharge hole that communicate with the purification channel, and wherein the insulator is formed with the purification channel housing protruding rearward.

14. The refrigerator of claim 12, wherein an area of the front heat exchanger in an up-down direction and an left-right direction is smaller than an area of the rear heat exchanger in the up-down and left-right directions, and the sum of the areas of the front heat exchanger and the rear heat exchanger is larger than an area of the duct in the up-down and left-right directions.

15. The refrigerator of claim 1, wherein the fan includes:

a fan motor; and a fan housing outside the fan motor and having a discharge guide integrally protruding from an upper surface to guide air to the first channel, and wherein the discharge guide has a defrost water drain hole.

16. A refrigerator comprising:

a duct that divides an inside of the refrigerator into a storage compartment and an air channel, the duct having a first port and a second port;

an air guide that divides the air channel into a first channel communicating with the first port and a second channel guiding air in the first channel to the second port;

a heat exchanger provided in the first channel;

a fan that suctions in air from the storage compartment and outputs the air to the first channel;

a pantry bin provided in the storage compartment and positioned to be cooled by air discharged through the second port; and a damper that controls air discharged to the second port from the second channel, wherein the second port is biased to one of left or right side from a vertical central axis of the duct, and wherein the duct includes a protrusion that extends forward at a lower portion, and the fan and the damper are provided in the protrusion.

17. A refrigerator comprising:

a duct that divides an inside of the refrigerator into a storage compartment and an air channel, the duct having a first port and a second port;

an air guide that divides the air channel into a first channel communicating with the first port and a second channel guiding air in the first channel to the second port;

a heat exchanger provided in the first channel;

a fan that suctions in air from the storage compartment and outputs the air to the first channel;

a pantry bin provided in the storage compartment and positioned to be cooled by air discharged through the second port; and a damper that controls air discharged to the second port from the second channel, wherein the second port is biased to one of left or right side from a vertical central axis of the duct, and wherein the second channel includes:

an upper channel positioned at a side of the first channel;

a lower channel positioned over the damper and not overlapping the upper channel in an up-down direction; and an inclined channel connecting the upper channel and the lower channel.

* * * * *